US005718062A

United States Patent [19]

de Vroome

[11] Patent Number: 5,718,062

[45] Date of Patent: Feb. 17, 1998

[54] METHOD AND APPARATUS FOR PREVENTING THE OCCURRENCE OF AN EXPLOSIVE STATE IN GAS MIXTURES IN CONFINED SPACES

[75] Inventor: Clemens Johannes M. de Vroome, Beugen, Netherlands

[73] Assignee: Heidelberg Contiweb B.V., Boxmeer, Netherlands

[21] Appl. No.: 730,895

[22] Filed: Oct. 18, 1996

Related U.S. Application Data

[63] Continuation of Ser. No. 468,780, Jun. 6, 1995.

[30] Foreign Application Priority Data

Jun. 15, 1994 [EP] European Pat. Off. ..... 94201718

[51] Int. Cl.[6] ..... F26B 3/00

[52] U.S. Cl. ..... 34/494; 34/538

[58] Field of Search ..... 34/532, 538, 539, 34/376, 377, 378, 379, 380, 445, 446, 475, 476, 486, 491, 493, 494, 497, 550, 575, 72, 444; 432/8, 59, 72; 110/210, 211, 214

[56] References Cited

U.S. PATENT DOCUMENTS

| | | | |
|---|---|---|---|
| 3,314,159 | 4/1967 | Betz | 34/72 |
| 3,486,841 | 12/1969 | Betz | 23/2 |
| 3,882,612 | 5/1975 | Try et al. | 432/72 |
| 4,098,007 | 7/1978 | Davis et al. | 34/72 |
| 4,150,495 | 4/1979 | Stern | 34/567 |
| 4,199,549 | 4/1980 | Wilt . | |
| 4,343,096 | 8/1982 | Bergland | 34/538 |
| 4,649,834 | 3/1987 | Heran et al. | 110/210 |
| 5,367,787 | 11/1994 | Ikeda et al. | 34/494 |

FOREIGN PATENT DOCUMENTS

| | | | |
|---|---|---|---|
| 0 385 411 | 9/1990 | European Pat. Off. | B01D 53/34 |
| 0 427 308 | 5/1991 | European Pat. Off. | F26B 21/06 |

*Primary Examiner*—John M. Sollecito
*Assistant Examiner*—Steve Gravini
*Attorney, Agent, or Firm*—Deveau, Colton & Marquis

[57] ABSTRACT

In a method for preventing the occurrence of an explosive state in a gas mixture, especially of solvents in air, in an essentially confined space, virtually complete oxidation of at least part of the gas mixture taking place, either the temperature difference $\Delta T$ between the temperatures of the gas mixture before and after the oxidation is determined, and if the temperature difference $\Delta T$ is greater than a maximal permissible temperature increase $\Delta T_{max}$, safety measures are taken, or the temperature $T_1$ of the gas mixture before the oxidation and the temperature $T_2$ of the gas mixture after the oxidation are measured, and the measured temperatures $T_1$ and $T_2$ are compared with a minimum temperature $T_{min}$ before oxidation of the gas mixture and a maximum temperature $T_{max}$ after oxidation of the gas mixture, the difference between $T_{max}$ and $T_{min}$ being less than, or equal to, the maximal permissible temperature increase $\Delta T_{max}$, and if the measured temperatures $T_1$ and $T_2$ are outside the interval determined by the maximum and minimum temperatures $T_{max}$ and $T_{min}$, safety measures are taken. In addition, the use of this method in drying webs printed with ink, and an appliance for this purpose are described.

18 Claims, 4 Drawing Sheets

METHOD AND APPARATUS FOR PREVENTING THE OCCURRENCE OF AN EXPLOSIVE STATE IN GAS MIXTURES IN CONFINED SPACES

This is a continuation of copending application Ser. No. 08/468,780 filed on Jun. 6, 1995.

BACKGROUND OF THE INVENTION

The invention relates to a method for preventing the occurrence of an explosive state in gas mixtures, especially of solvents in air, in an essentially confined space, virtually complete oxidation of at least part of the gas mixture taking place.

Such a method is disclosed, for example, by the Dutch Laid-Open Patent Application 8902754. In this known method, the concentration of solvents in a drying appliance for drying webs of base material is controlled, said webs being printed with an ink containing volatile solvent, a gas mixture containing evaporated solvents being combusted. This concentration monitoring comprises measuring the heat increase, caused by combustion, of the gas mixture in the combustion device, and the amount of heat supplied by the fuel, the heat of combustion of the solvent being determined from the difference between these, whereupon the concentration of the solvent is calculated.

Monitoring of the concentration of the solvents which evaporate from the ink during drying, in the drying appliance is necessary, because this concentration should be kept below a certain value. This value is determined, in the first instance, by safety requirements which generally apply to rooms in which flammable substances are located. In the known drying appliance, this value is also defined by the fact that the circulating gas mixture must not become saturated with solvents, because otherwise no evaporation and therefore no drying can take place. If the concentration of the solvent exceeds the value defined by the safety standard, the appliance should be switched off. This safety standard is generally set to a certain percentage of the lower explosive limit of the solvent in air.

A drawback of the known method is that the calculation of the concentration of the solvent requires a large number of measurements and thus a large number of measuring instruments and computation aids. In order to calculate, from an energy balance, the concentration of the solvent, the temperature and the flow rate of the gas mixture supplied to the combustion device need to be measured, as well as the temperature of the gas mixture after combustion and the flow rate of the fuel supplied to the combustion device. Based on the known heat of combustion of the fuel and the solvent, the concentration of the solvent in the combustion device is then calculated. Each solvent, however, has a specific heat of combustion, so that a general assumption is made for this purpose, which reduces the accuracy of the calculated concentration. In addition, the measuring instruments require regular calibration, are expensive and prone to faults.

An alternative for preventing the occurrence of an explosive state in gas mixtures by monitoring the concentration of flammable substances in a gas mixture are direct concentration measurements. The measuring apparatus required for this purpose is, however, likewise very expensive and prone to faults, and requires regular calibration.

SUMMARY OF THE INVENTION

It has now been found that explosive states in gas mixtures can be prevented by means of a method in which only a temperature difference is measured or only two temperatures are measured.

The object of the invention is to implement, in a simple manner, a method for preventing the occurrence of an explosive state in gas mixtures in an essentially confined space by solely carrying out temperature measurements, avoiding the abovementioned drawbacks.

It has further been found that there is a relationship between the maximal permitted concentration of a flammable substance in a gas mixture and the temperature increase during oxidation thereof, which is independent of the type of the flammable substance.

A further object of the invention is to provide a method for preventing the occurrence of an explosive state in gas mixtures in an essentially confined space, which method makes use of this relationship.

Another object of the invention is to provide such a method which is independent of the type of the flammable substance.

A further object of the invention is to provide a method for drying webs printed with ink containing solvent, in which method the method for preventing the occurrence of an explosive state in a gas mixture of solvent and air can be used.

Yet another object of the invention is to provide a drying appliance for implementing the drying method according to the invention.

The method of the abovementioned type according to the invention is characterized in that the temperature difference $\Delta T$ between the temperatures of the gas mixture before and after the oxidation is determined, and if the temperature difference $\Delta T$ is greater than a maximal permissible temperature increase $\Delta T_{max}$, safety measures are taken.

It was found that, if the temperature difference $\Delta T$ between the temperatures of the gas mixture to be oxidized and the oxidized gas mixture is smaller than the previously set maximally permissible temperature difference $\Delta T_{max}$, the concentration of the flammable substance in the gas mixture is below the maximally permitted concentration on the basis of the safety standard. The maximally permissible temperature difference $\Delta T_{max}$, for most of the flammable substances used, depends solely on the safety standard and can be determined empirically for each standard. It was also found that here the type of the flammable substance and the type of the oxidation cell are not important, so that, once the correct maximal permissible temperature difference $\Delta T_{max}$ has been determined, rooms in which different flammable substances are present alternately can be safeguarded without the need to adjust $\Delta T_{max}$. In order to safeguard the confined space, it is therefore sufficient to measure the temperature difference between the temperature of the gas mixture supplied to the oxidation cell and the temperature of the gas stream formed after the oxidation. If the measured temperature difference is greater than the maximal permissible temperature difference $\Delta T_{max}$, suitable safety measures, for example switching off the oxidation cell and/or ventilation of the confined space, should be taken. Generally, these safety measures are stipulated.

Oxidation of the gas mixture can be performed, for example, by combustion thereof with the aid of an auxiliary fuel in a combustion device or by catalytic reaction of the gas mixture with the aid of a suitable catalyst.

Other advantages of the method according to the invention are the obviation of regular calibration of the measuring instruments, the measuring instruments being stable in time and requiring no maintenance.

For the purpose of measuring the temperature difference or the real temperatures, simple measuring instruments such as thermocouples can be used.

BRIEF DESCRIPTION OF THE DRAWINGS

The invention will be illustrated hereinafter with reference to the accompanying drawing, in which.

DETAILED DESCRIPTION OF THE INVENTION

Figure 1:
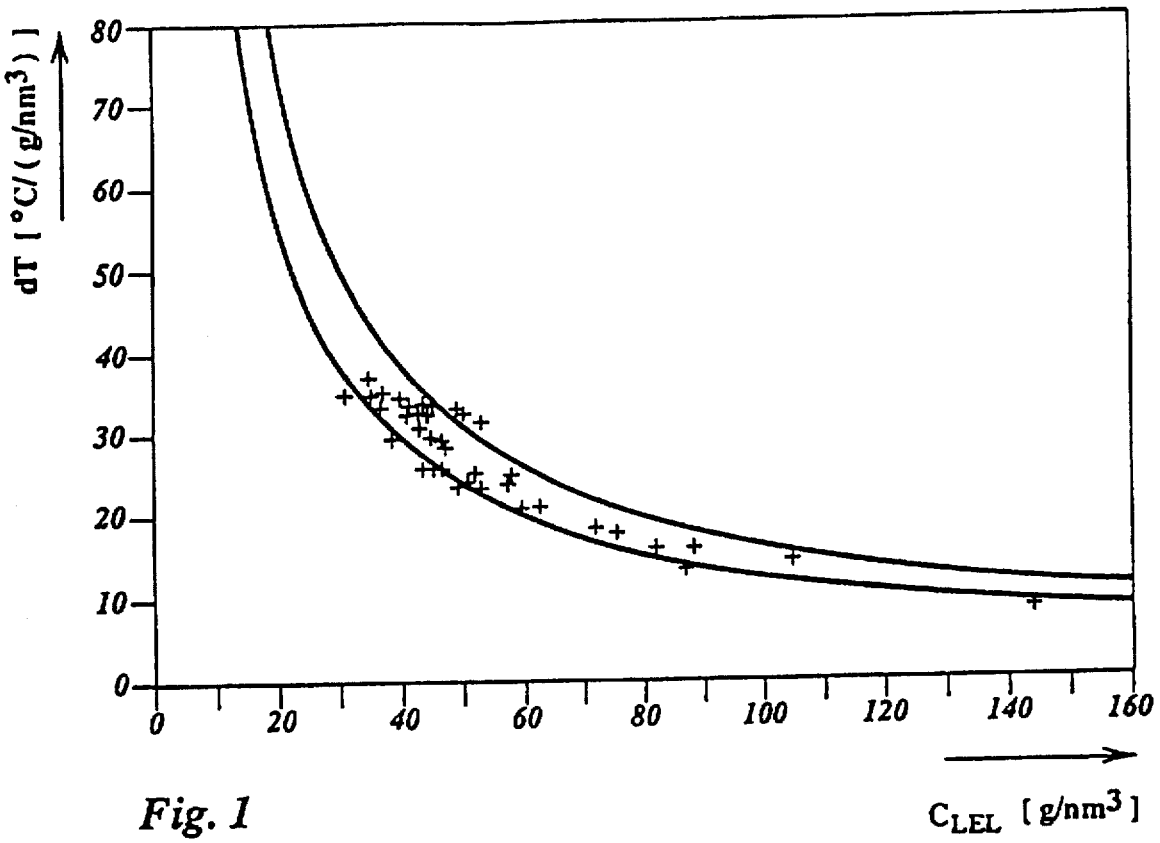
FIG. 1 is a graph which depicts the relationship between the temperature increase produced during oxidation of a gas mixture and the concentration of the flammable substance in the gas mixture at the lower explosive limit.

To supplement the temperature difference measurement, according to a preferred embodiment of the method according to the invention, the temperature $T_2$ of the gas mixture after the oxidation is also measured, and, if the measured temperature $T_2$ exceeds a certain value or is outside a certain temperature range, safety measures are taken. Thus, an additional safeguard is incorporated. It is within the scope of the invention to measure, instead of or in addition to the temperature of the gas mixture after the oxidation, the temperature $T_1$ of the gas mixture before the oxidation and to monitor this temperature $T_1$.

The invention also relates to a method of the type mentioned at the outset, in which, instead of a temperature difference measurement, the actual temperatures before and after the oxidation are measured. This method according to the invention is characterized in that the temperature $T_1$ of the gas mixture before the oxidation and the temperature $T_2$ of the gas mixture after the oxidation are measured, and the measured temperatures $T_1$ and $T_2$ are compared with a minimum temperature $T_{min}$ before oxidation of the gas mixture and a maximum temperature $T_{max}$ after oxidation of the gas mixture, the difference between $T_{max}$ and $T_{min}$ being less than, or equal to, the maximal permissible temperature increase $\Delta T_{max}$, and if the measured temperatures $T_1$ and $T_2$ are outside the interval determined by the maximum and minimum temperatures $T_{max}$ and $T_{min}$, safety measures are taken.

In this use of the relationship found between the maximal permitted concentration and the temperature increase during oxidation to safeguard a confined space, the actual temperatures before and after the oxidation are measured and compared with a predetermined maximum temperature $T_{max}$ after oxidation and a minimum temperature $T_{min}$ before oxidation, the constraint applying that the difference between the maximum and minimum temperatures be equal to or smaller than the maximal permissible temperature increase $\Delta T_{max}$. In this case, it is therefore not the temperature difference which is monitored, but the temperature $T_1$ before the oxidation and the temperature $T_2$ after the oxidation.

Preferably, the maximal temperature increase is constrained on the basis of the maximal permitted concentration of the flammable substances in the gas mixture. Consequently, reliable safeguarding can be effected.

For the most commonly used solvents and other flammable gases, the maximal permissible temperature increase $\Delta T_{max}$ is within a narrow range. For a customary safety standard of 25% of the concentration of the flammable substance at the lower explosive limit, the maximal permissible temperature increase $\Delta T_{max}$ is in the range of 300°–400° C. It should be noted that, if a different standard applies, the maximal temperature increase should be adjusted accordingly. This can be determined empirically or be calculated accurately from the safety standard in a manner as described hereinafter.

In a preferred embodiment of the method according to the invention, the maximal permissible temperature increase $\Delta T_{max}$ is determined from the temperature increase during the oxidation of the gas mixture according to the equation $\Delta T_{max}=k*dT*C_{LEL}$, where $\Delta T_{max}$ is the maximal permissible temperature increase [°C.], k is a factor which depends on the safety standard, dT is the specific temperature increase [°C./(g/Nm$^3$)] and $C_{LEL}$ is the concentration [g/Nm$^3$] of the flammable substance at the lower explosive limit. The values of dT and $C_{LEL}$ are reported in handbooks for the most common substances or can be calculated therefrom, while the factor which depends on a safety standard is prescribed by government or other safety authorities. Thus it is possible to calculate accurately, for every substance in the gas mixture, the associated maximal permissible temperature increase $\Delta T_{max}$.

The factor depending on the safety standard will characteristically be in the range of 0.15–0.99.

It is possible to derive, from the maximal permissible temperature increase $\Delta T_{max}$ and the properties of the device in which the oxidation of the gas mixture takes place, the maximum temperature $T_{max}$ after the oxidation and the minimum temperature $T_{min}$ before the oxidation.

Advantageously, the maximum temperature $T_{max}$ is the maximal temperature of the discharged gases. Thus, efficient, good oxidation is effected, while the concentration is kept below the safety standard.

In order to utilize the heat produced during oxidation, it is possible to employ heat exchange between the gas mixture before the oxidation and at least part of the oxidized gas mixture. In so doing, there are various alternatives for the point where the temperature difference or the different temperatures can be measured. Depending on the position, the maximum and minimum temperatures need or need not be adjusted.

If the temperature difference is monitored, advantageously the temperature difference $\Delta T$ between the temperature of the gas mixture before the oxidation at a point between the heat exchange and the oxidation, and the temperature of the gas mixture after the oxidation at a point between the oxidation and the heat exchange is determined.

In another embodiment of this method according to the invention, advantageously the temperature difference $\Delta T$ between the temperature of the gas mixture before the oxidation at a point upstream of the heat exchange, and the temperature of the oxidized gas mixture at a point downstream of the heat exchange with the gas mixture before the oxidation is determined.

If, instead of the temperature difference, the temperatures $T_1$ and $T_2$ are monitored, there are again a number of possibilities for so doing.

In the first version, advantageously the temperature $T_1$ of the gas mixture before the oxidation is measured at a point between the heat exchange and the oxidation, and the temperature $T_2$ of the gas mixture after the oxidation is measured at a point between the oxidation and the heat exchange.

According to the second version, the temperature $T_1$ of the gas mixture before the oxidation is measured at a point upstream of the heat exchange, and the temperature $T_2$ of the oxidized gas mixture is measured at a point downstream of the heat exchange with the gas mixture before the oxidation. In so doing, the minimum and maximum temperatures, $T_{min}$ and $T_{max}$, respectively, need to be adjusted to the temperature increase and decrease, respectively, caused by the heat transfer.

The method for preventing the explosives if an explosive situation in gas mixtures according to the invention can be applied over a wide range of industrial fields, in which the concentration of flammable substances needs to be kept below a certain value in order to avoid dangerous situations. A non-limiting listing of examples comprises, inter alia, the safeguarding of storerooms, coating lines, combustion installations, pipeline systems and the like. A particular field of application of the method according to the invention is the graphic industry.

The invention also relates to a method for drying webs printed with ink containing solvents, using a safeguarding method according to the invention.

In addition, the invention relates to a drying appliance for drying the webs printed with ink containing solvents, in which appliance a safeguarding method according to the invention is used.

Employing the monitoring method according to the invention ensures safety, in a simple, inexpensive and reliable manner, during drying of the printed webs and oxidation of the evaporated solvents.

FIG. 1 is a graph in which, for a large number of solvents and the like, the specific temperature increase dT [°C./(g/Nm$^3$)] as a function of the concentration at the lower explosive limit $C_{LEL}$ [g/Nm$^3$] is depicted. These values are indicated with a "+" sign. As can be seen, this temperature increase for the most common, flammable and environmentally damaging substances is in a narrow range whose boundaries are depicted as continuous curves. By taking into account the factor k determined by the safety standard, it is possible to determine therefrom the maximal permissible temperature increase $\Delta T_{max}$ and/or the minimum temperature $T_{min}$ before oxidation and the maximum temperature $T_{max}$ after oxidation.

Figure 2:
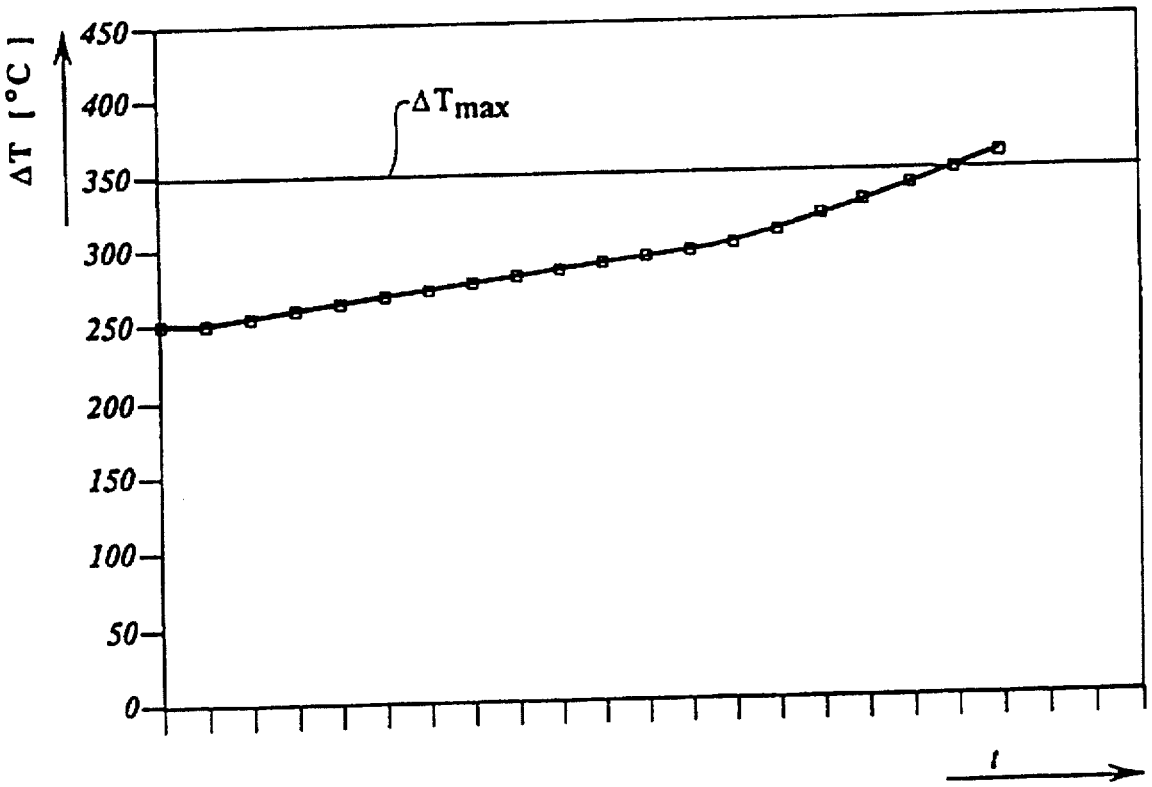
FIG. 2 is a graph in which, according to an embodiment of the method according to the invention, the temperature difference $\Delta T$ is monitored.

FIG. 2 shows a graph in which, according to one embodiment of the method according to the invention, the temperature difference $\Delta T$ has been measured as a function of time. The maximal permissible temperature difference $\Delta Tm_{max}$ has been set to 350° C. in this example. The variation of $\Delta T$ with time is shown as a continuous curve. In this example, the measured temperature difference $\Delta T$ after some time becomes greater than the maximally permissible temperature difference $\Delta T_{max}$, at which time an alarm will become active.

Figure 3:
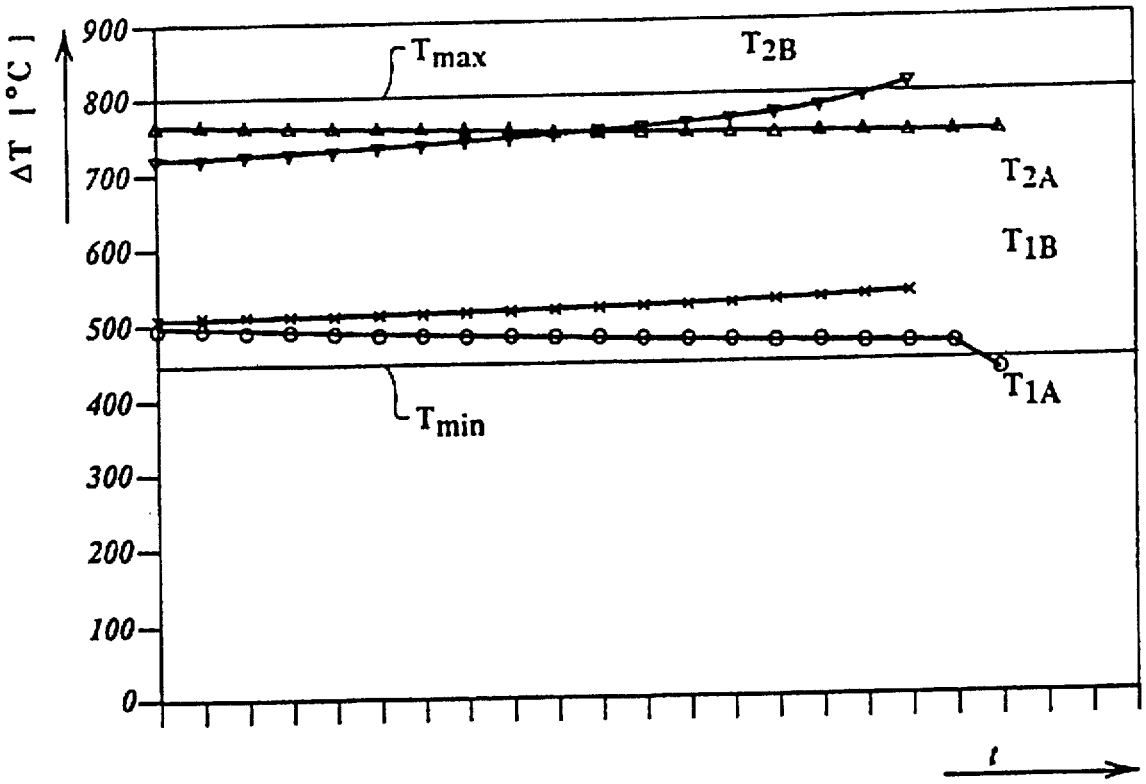
FIG. 3 is a graph in which, according to another embodiment of the method according to the invention, the temperature $T_1$ before the oxidation and the temperature $T_2$after the oxidation of the gas mixture are measured.

In FIG. 3, a graph is drawn in which, according to another embodiment of the method according to the invention, the temperature $T_1$ before the oxidation of the gas mixture and the temperature $T_2$ after the oxidation of the gas mixture are measured against time. The maximum temperature $T_{max}$ derived from the maximally permissible temperature increase $\Delta T_{max}$ (in this example likewise 350° C.) has been set to 800° C., and the minimum temperature $T_{min}$ has been set to 450° C. This graph shows two different situations, A and B, respectively. In situation A, the measured temperature before oxidation of the gas mixture $T_{1A}$ becomes lower than $T_{min}$ after some time, so that an alarm will become active, while in situation B the measured temperature after oxidation of the gas mixture $T_{2B}$ becomes larger than $T_{max}$, so that an alarm will become active and suitable safety measures will be taken. This graph likewise shows that in situation B the difference between $T_{2B}$ and $T_1$ remains smaller than the maximally permissible temperature increase $\Delta T_{max}$ of 350° C., while nevertheless an alarm becomes active.

If desired, the measuring principles shown in FIGS. 2 and 3 may be combined, in part or as a whole, so that, in addition to a measurement of the temperature difference $\Delta T$, the temperature $T_2$ of the gas mixture after oxidation and/or the temperature $T_1$ of the gas mixture before oxidation are also measured.

Figure 4:
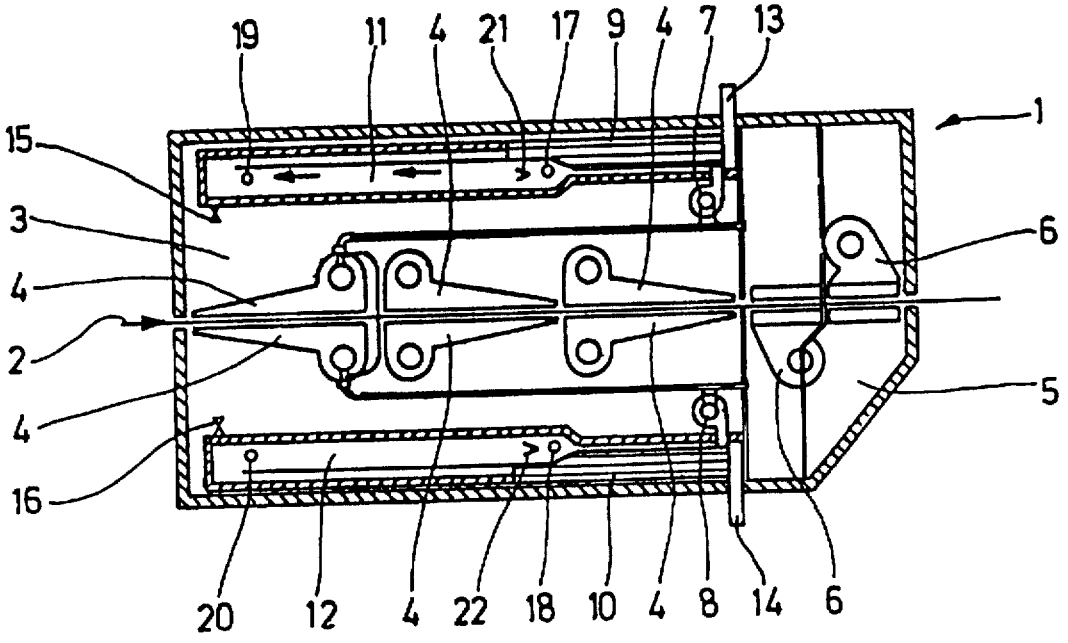
FIG. 4 is a schematic sectional view of an embodiment of a drying appliance according to the invention.

In FIG. 4, an embodiment of the drying appliance according to the invention is indicated in its entirety by the reference numeral 1. Through of the appliance 1, a web 2 is guided via suitable conveying means (not shown), the web being printed with an ink containing solvents. In the embodiment shown, the drying appliance 1 comprises a drying chamber 3 in which, both above and below the web 2, a plurality of blowing devices 4, provided with a large number of nozzles (not shown) are set up, through which a heated gaseous medium, generally air, is blown onto the web 2 in order to evaporate the solvents from the ink. After the web 2 has been dried, it is passed through a cooling chamber 5, in which the web 2 is cooled with the aid of cold air which is blown onto the dried web 2 with the aid of blowing devices 6. Part of the gaseous medium, which is loaded with evaporated solvents, is passed, via fans 7 and 8 and heat exchangers 9 and 10, to a combustion chamber 11 arranged above the web 2 and a combustion chamber 12 arranged below the web 2, respectively, in which chambers, with the aid of burners 21 and 22, the gas mixture is combusted. In the heat exchangers 9 and 10, heat is transferred from a branch stream of the combusted gas mixture to the gas mixtures supplied to the combustion chambers 11, 12. The branch streams leave the drying appliance 1 via the discharge ducts 13 and 14. The remaining part of the combusted gas mixture is passed into the drying chamber 3 via supply valves 15 and 16, whereupon it can be reused for drying the web 2.

In order to prevent the occurrence of an explosive state of the solvent in air in the drying appliance 1, so that safety measures are taken if the maximally permissible concentration is exceeded, the temperature $T_1$ of the gas mixture supplied to the combustion chambers 11 and 12 is measured with the aid of thermocouples 17 and 18. The temperature $T_2$ of the combusted gas mixtures is measured with the aid of thermocouples 19 and 20. The temperature monitoring is thus carried out in accordance with FIG. 3. If the temperature $T_1$ of the incoming gas mixture is too low ($<T_{min}$), or the temperature $T_2$ of the combusted gas mixture is too high ($>T_{max}$), suitable safety measures are taken.

It is found that, if the actual measured temperatures $T_1$ and $T_2$ are within the temperature interval defined by the minimum temperature $T_{min}$ and maximum temperature $T_{max}$, the concentrations of the solvents, irrespective of the type of solvent, are below the maximally permitted concentrations.

If the heat exchanger does not function correctly, the temperature $T_1$ of the gas mixture supplied to the combustion chamber will be too low. By measuring the temperature of the gas mixture supplied to the combustion chamber at a point between the heat exchanger and the combustion chamber, as in the set-up of the temperature measuring elements in this figure, a check can be carried out at the same time regarding the performance of the heat exchanger.

The safety of the appliance amply meets the standards set down, because the maximally permissible temperature difference $\Delta T_{max}$ is predetermined on the basis of the maximally permitted concentration, whereas in reality, owing to the contribution of the heat exchange and the combustion of the auxiliary fuel in order to combust the solvents, the temperature range remaining for the contribution of the solvents is smaller than the maximally permissible temperature difference $\Delta T_{max}$.

What is claimed is:

1. A method for preventing the occurrence of an explosive state in gas mixtures, especially of solvents in air, in an essentially confined space, virtually complete oxidation of at least part of the gas mixture taking place, wherein the temperature difference $\Delta T$ due to said oxidation is determined, $\Delta T$ being the temperature difference between the temperature of the gas mixture after said oxidation minus the temperature of the gas mixture before said oxidation, $\Delta T$ being positive, and if the temperature difference $\Delta T$ is greater than a maximal permissible temperature increase $\Delta T_{max}$, safety measures are taken.

2. A method according to claim 1, wherein additionally the temperature $T_2$ of the gas mixture after oxidation is measured, and if the measured temperature $T_2$ exceeds a certain value or is outside a certain temperature range, safety measures are taken.

3. A method according to claim 1, wherein the maximal permissible temperature increase $\Delta T_{max}$ is constrained on the basis of the maximal permitted concentration of the flammable substances in the gas mixture.

4. A method according to claim 3, wherein $\Delta T_{max}$ is in the range of 300°–400° C.

5. A method according to claim 3, wherein the maximal permissible temperature increase $\Delta T_{max}$ is determined from the temperature increase during the oxidation of the gas mixture according to the equation $\Delta T_{max}=k*dT*C_{LEL}$, where $\Delta T_{max}$ is the maximal permissible temperature increase [° C.], k is a factor which depends on the safety standard, dT is the specific temperature increase [°C./(g/Nm$^3$)] and $C_{LEL}$ is the concentration [g/Nm$^3$] of the flammable substance at the lower explosive limit.

6. A method according to claim 5, wherein the factor k is in the range of 0.15–0.99.

7. A method according to claim 1, in which a heat exchange between the gas mixture before the oxidation and at least part of the oxidized gas mixture is employed, wherein the temperature difference $\Delta T$ between the temperature of the gas mixture before the oxidation at a point between the heat exchange and the oxidation, and the temperature of the gas mixture after the oxidation at a point between the oxidation and the heat exchange is determined.

8. A method according to claim 1, in which a heat exchange between the gas mixture before the oxidation and at least part of the oxidized gas mixture is employed, wherein the temperature difference $\Delta T$ between the temperature of the gas mixture before the oxidation at a point upstream of the heat exchange, and the temperature of the oxidized gas mixture at a point downstream of the heat exchange with the gas mixture before the oxidation is determined.

9. A method for preventing the occurrence of an explosive state in gas mixtures, especially of solvents in air, in an essentially confined space, virtally complete oxidation of at least part of the gas mixture taking place, wherein the temperature $T_1$ of the gas mixture before the oxidation and the temperature $T_2$ of the gas mixture after the oxidation are measured, $T_2$ being higher than $T_1$, and the measured temperatures of $T_1$ and $T_2$ are compared with a minimum temperature $T_{min}$ before oxidation of the gas mixture and a maximum temperature $T_{max}$ after oxidation of the gas mixture, the difference between $T_{max}$ and $T_{min}$ being less than, or equal to, the maximal permissible temperature increase $\Delta T_{max}$, and if the measured temperature $T_1$ and $T_2$ are outside the interval determined by the maximum and minimum temperatures $T_{max}$ and $T_{min}$, safety measures are taken.

10. A method according to claim 9, wherein the maximal permissible temperature increase $\Delta T_{max}$ is constrained on the basis of the maximal permitted concentration of the flammable substances in the gas mixture.

11. A method according to claim 10, wherein $\Delta T_{max}$ is in the range of 300°–400°C.

12. A method according to claim 10, wherein the maximal permissible temperature increase $\Delta T_{max}$ is determined from the temperature increase during the oxidation of the gas mixture according to the equation $\Delta T_{max}=k*dT*C_{LEL}$, where $\Delta T_{max}$ is the maximal permissible temperature increase [° C.], k is a factor which depends on the safety standard, dT is the specific temperature increase [° C./(g/Nm$^3$)] and $C^{LEL}$ is the concentration [g/Nm$^3$] of the flammable substance at the lower explosive limit.

13. A method according to claim 12, wherein the factor k is in the range of 0.15–0.99.

14. A method according to claim 9, wherein the maximum temperature $T_{max}$ is the maximal temperature of the discharged gases.

15. A method according to claim 9, in which a heat exchange between the gas mixture before the oxidation and at least part of the oxidized gas mixture is employed, wherein the temperature $T_1$ of the gas mixture before the oxidation is measured at a point between the heat exchange and the oxidation, and the temperature $T_2$ of the gas mixture after the oxidation is measured at a point between the oxidation and the heat exchange.

16. A method according to claim 9, in which a heat exchange between the gas mixture before the oxidation and at least part of the oxidized gas mixture is employed, wherein the temperature $T_1$ of the gas mixture before the oxidation is measured at a point upstream of the heat exchange, and the temperature $T_2$ of the oxidized gas mixture is measured at a point downstream of the heat exchange with the gas mixture before the oxidation.

17. A method for drying webs printed with ink containing solvents, using a safeguarding method according to any one of claims 1–16.

18. A drying appliance for drying webs printed with ink containing solvents, in which appliance a safeguarding method according to any one of claims 1–16 is used.

* * * * *